United States Patent [19]

Shioda

[11] Patent Number: 4,463,794

[45] Date of Patent: Aug. 7, 1984

[54] APPARATUS FOR PRODUCING CONTAINERLESS SAND MOLDS

[75] Inventor: Toshiyuki Shioda, Obu, Japan

[73] Assignee: Kabushiki Kaisha Toyoda Jidoshokki Seisakusho, Aichi, Japan

[21] Appl. No.: 420,748

[22] Filed: Sep. 21, 1982

Related U.S. Application Data

[63] Continuation of Ser. No. 182,056, Aug. 28, 1980, abandoned.

[30] Foreign Application Priority Data

Sep. 17, 1979 [JP] Japan ..... 54-119015

[51] Int. Cl.[3] ..... B22C 17/00; B22C 21/08

[52] U.S. Cl. ..... 164/182; 164/44

[58] Field of Search ..... 164/181, 182, 183, 187, 164/195, 213, 224, 210, 44; 414/754, 758, 783, 225

[56] References Cited

U.S. PATENT DOCUMENTS

| | | | |
|---|---|---|---|
| 3,589,431 | 6/1971 | Fellows | 164/187 X |
| 3,630,268 | 12/1971 | Hatch | 164/224 X |
| 4,018,343 | 4/1977 | Perhed | 414/758 X |

*Primary Examiner*—Nicholas P. Godici
*Assistant Examiner*—Thomas S. Mieczkowski
*Attorney, Agent, or Firm*—Burgess, Ryan and Wayne

[57] ABSTRACT

A match plate mold-producing apparatus is provided with at least a pair of molding flasks for an upper and a lower sand mold. The pair of molding flasks is alternately positioned in a first mold-forming station in which a match plate carrying thereon a pattern or patterns is vertically held between a pair of squeezing devices movable toward and away from one another along a horizontal axis, and in a second mold-removing station in which mold-jointing operation and mold-removing operation are carried out by cooperation of a vertically movable flask-support device, a vertically movable mold-support device and a vertically movable mold-removing device.

4 Claims, 6 Drawing Figures

APPARATUS FOR PRODUCING CONTAINERLESS SAND MOLDS

FIELD OF THE INVENTION

This is a continuation of application Ser. No. 182,056, filed Aug. 28, 1980, now abandoned.

The present invention relates to the automatic production of containerless sand molds and, more particularly, relates to an apparatus for producing containerless sand molds by the employment of a match plate carrying thereon a pattern or patterns and molding flasks.

DESCRIPTION OF PRIOR ART

One typical prior art of apparatus for producing containerless sand molds by the employment of a match plate is disclosed in the U.S. Pat. No. 3,589,431. In the prior art apparatus, permanent molding flasks are passed through a plurality of operating stations for making a complete sand mold which is used for casting a cast product. The operating stations are arranged around a turnable about a vertical axis, and are angularly spaced apart from one another. However, the construction and the operation of the prior art apparatus is considerably complex, and a large floor space is needed for installing the apparatus.

DESCRIPTION OF THE INVENTION

An object of the present invention is, therefore, to provide a match plate sand mold-producing apparatus which is simple in construction and operation thereof and, requires a small floor space for installing the apparatus.

Another object of the present invention is to provide an automatic match plate molding apparatus provided with means for simply changing a pattern or patterns on the match plate to a different pattern or patterns during the continuous production process for containerless sand molds.

The present invention will be more apparent from the ensuing description of preferred embodiments of the present invention with reference to the accompanying drawings wherein.

Figure 1:
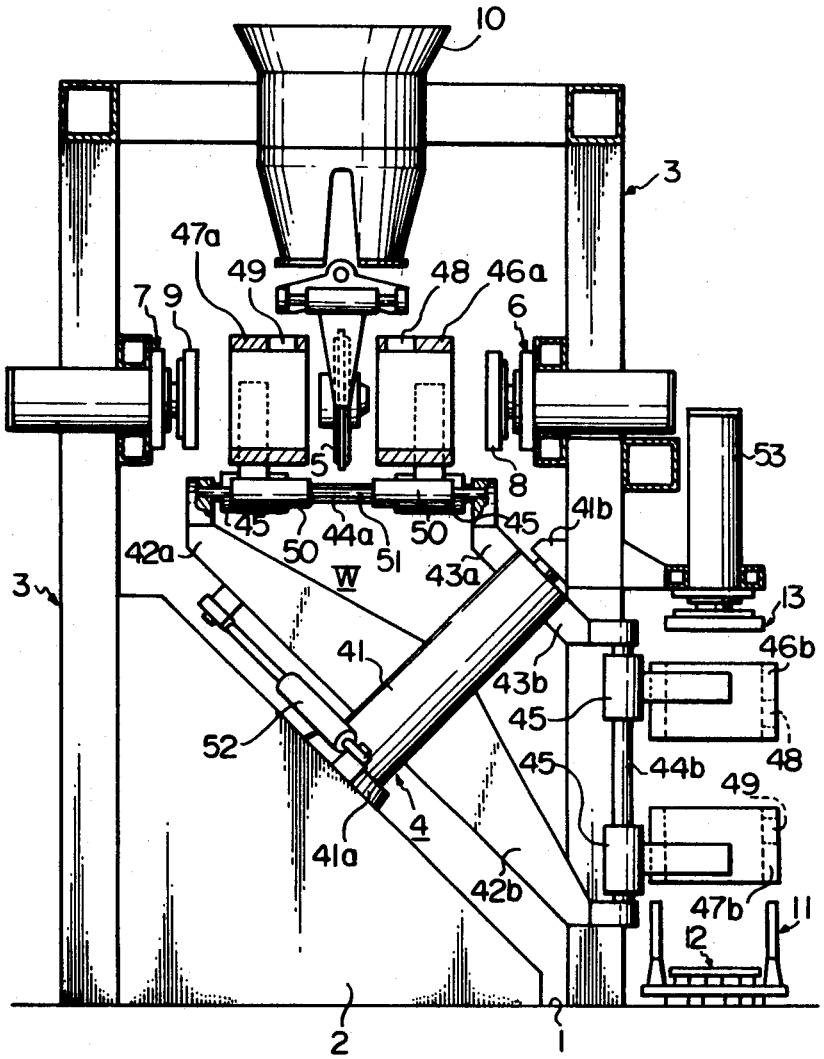
FIG. 1 is a front elevational view of a match plate molding apparatus according to an embodiment of the present invention.

Referring now to FIG. 1, a match plate molding apparatus, according to an embodiment of the present invention, is provided with a base 2 placed on a ground floor 1 and a rigid machine framework 3 assembled on the floor 1. The machine framework 3 generally extends upwardly and defines therein a working space W. In the working space W, a flask device 4 is rigidly attached to the machine framework 3 and the base 2. The flask device 4 has a rotating shaft 41 which upwardly inclines forty-five degrees from a horizontal line. The rotating shaft 41 is rotatably supported between bearing means 41*a* and 41*b*. The flask device 4 also has a first pair of long and short arms 42*a* and 43*a* extending radially from the rotating shaft 41, and in parallel with one another, and a second pair of long and short arms 42*b* and 43*b* extending radially from the rotating shaft 41, and in parallel with one another. The first pair of arms 42*a* and 43*a* support two parallel guide rods 44*a* (only one guide rod can be seen in FIG. 1), a pair of molding flasks 46*a* and 47*a* for an upper and a lower mold, respectively, and a pair of fluid cylinder devices 50 having a common piston rod 51. The molding flasks 46*a* and 47*a* are coaxial with one another and are slidably mounted on the guide rods 44*a* by means of support legs 45, respectively. The two parallel guide rods 44*a* are arranged so as to incline forty-five degrees from the axis of the rotating shaft 41. The molding flasks 46*a* and 47*a* are slidable toward and away from one another along the guide rods 44*a* by the actuation of the fluid cylinder device 50.

The second pair of arms 42*b* and 43*b* support two parallel rods 44*b* (only one guide rod can be seen in FIG. 1), a pair of molding flasks 46*b* and 47*b* for an upper and a lower mold, respectively, and a pair of fluid cylinder devices (not illustrated in FIG. 1) similar to the devices 50. The molding flasks 46*b* and 47*b* are slidably mounted on the guide rods 44*b* by means of support legs 45, respectively, and are coaxial with one another. The sliding motion of the molding flasks 46*b* and 47*b* is caused by the actuation of the fluid cylinder devices. The two parallel guide rods 44*b* are arranged so as to incline fourty-five degrees from the axis of the rotating shaft 41. The first and second pairs of guide rods 44*a* and 44*b* are able to alternately assume a horizontal position and a vertical position due to the rotation of the flask device 4, which is caused by, for example, the actuation of a fluid cylinder 52. FIG. 1 illustrates a case where the guide rods 44*a* are positioned in the horizontal position, and the guide rods 44*b* are positioned in the vertical position. It should be understood that the above-mentioned horizontal position is a first opening station in which a mold-forming operation is carried out, while the above-mentioned vertical position is a second operating station in which the formed upper and lower molds are removed from the molding flasks and jointed together so that a composite containerless mold to be delivered to a casting station is formed. At this stage, it should be appreciated that, although FIG. 1 illustrates an embodiment in which the flask device 4 is provided with two pairs of molding flasks 46*a*, 47*a* and 46*b*, 47*b*, the number of pairs of molding flasks may be increased or decreased from the view point of controlling the time cycle for the mold producing operation. It should also be appreciated that each of the pairs of molding flasks 46*a*, 47*a* and 46*b*, 47*b* may be moved toward and apart from one another by a single fluid cylinder device intervened between the flasks 46*a* and 47*a* or between the flasks 46*b* and 47*b*. It should further be appreciated that some appropriate stops may be mounted on the guide rods 44*a* and 44*b*, so that the moving-apart motion of the molding flasks 46*a*, 47*a* and 46*b*, 47*b* is suitably limited by the stops. Alternately, the moving-apart motion of the molding flasks 46*a*, 47*a* and 46*b*, 47*b* may be limited by the fluid cylinder device or devices per se. In FIG. 1, when the guide rods 44*a* are in the horizontal position, that is, in the mold-forming station, a match plate 5 having two opposite vertical surface for mounting molding patterns is disposed between the molding flasks 46*a* and 47*a*. On the axially outer sides of the molding flasks 46*a* and 47*a*, a pair of squeezing devices 6 and 7 is disposed so as to be coaxial with the common horizontal axis of the molding flasks 46*a* and 47*a*. The squeezing devices 6 and 7 are held by the framework 3 and have respective squeezing plates 8 and 9. The squeezing plate 8 is able to move into and away from the molding flask 46*a*, and the squeezing plate 9 is able to move into and away from the molding flask 47*a*. At this stage, it should be appreciated that the squeezing plate 8 for squeezing an upper mold is formed, on the outer surface thereof, with a sprue forming pattern as well as a feeder head forming pattern (not illustrated in FIG. 1). A sand blower 10 for supplying molding sand into the molding flasks 46*a* and 47*a* is held at the uppermost part of the framework 3. In the second operating station, in which either the guide rods 44*a* and 44*b* are in the vertical position (FIG. 1 illustrates a case where the guide rods 44*b* are in the vertical position), a flask-support device 11 is disposed beneath and in alignment with the molding flasks 46*b* and 47*b*. The flask-support device 11 is movable toward and away from the lowermost end of the molding flask 47*b* by the actuation of a fluid cylinder. On the flask-support device 11, is mounted a mold-support device 12 which is movable vertically by the actuation of a fluid cylinder. It should be understood that, in the embodiment of FIG. 1, the fluid cylinder for the flask-support device 11 as well as the fluid cylinder for the mold-support device 12 are placed under the ground floor 1. The mold-support device 12 is able to upwardly move into the molding flask 47*b* by the actuation of the above-mentioned fluid cylinder. A mold-removing device 13, which is vertically movable by the actuation of a fluid cylinder 53, is disposed above and in alignment with the molding flasks 46*b* and 47*b*. The mold-removing device 13 is able to move into the molding flasks 46*b* and 47*b*, so as to remove the upper and lower molds from the molding flasks 46*b* and 47*b*. That is to say, when the upper and lower molds are removed from the molding flasks 46*b* and 47*b*, the mold-removing device 13 and the mold-support device 12 firstly hold therebetween the upper and lower molds within the molding flasks 46*b* and 47*b*, and subsequently, both devices 12 and 13 move downwardly together until both molds are pushed out of the molding flasks 46*b* and 47*b*. From the foregoing description of the arrangement of the match plate mold-forming apparatus of FIG. 1, it should be understood that the axis of rotation of the flask device 4 lies in the same vertical plane as a common vertical plane in which the horizontal axis of the first operating station and the vertical axis of the second operating station lie. Further, the axis of rotation of the flask device 4 extends along a line which bisects an angle between the horizontal and vertical axes.

The operation of the match plate molding apparatus of FIG. 1 will now be described hereinbelow with reference to FIGS. 1, 2 and 3.

Figure 2:
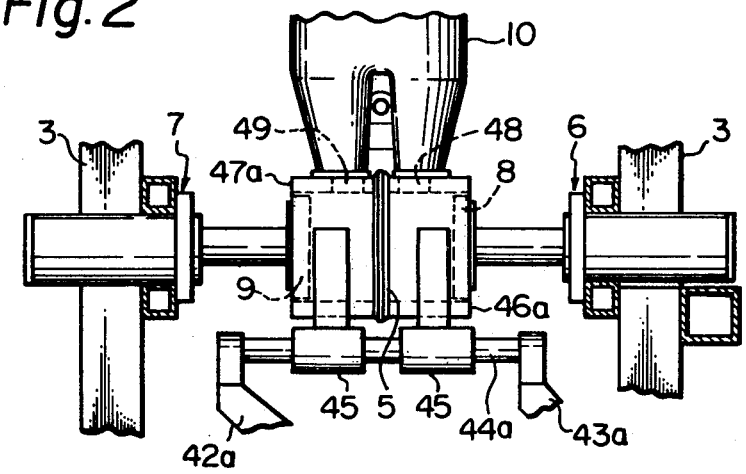
FIG. 2 is a partial front view of the apparatus of FIG. 1 for illustrating the operation thereof at a mold forming station.
Figure 3:
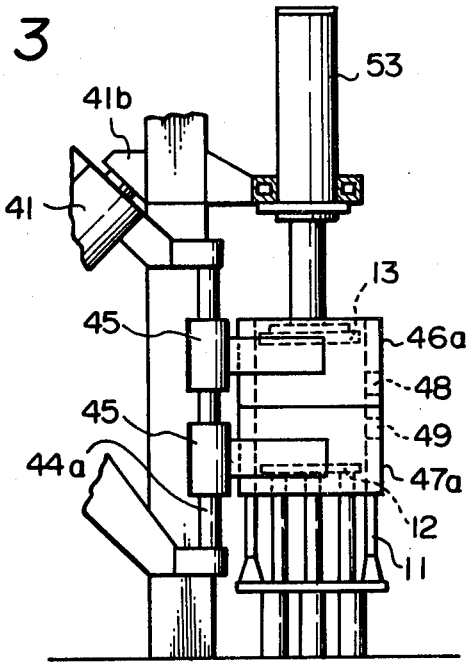
FIG. 3 is a partial front view of the apparatus of FIG. 1 for illustrating the operation thereof at a finishing station.

As illustrated in FIG. 1, when the flask device 4 is rotated so that, for example, a pair of vacant molding flasks 46*a* and 47*a* is positioned in the first operating station, that is, the mold-forming station, the vacant molding flasks 46*a* and 47*a* are moved toward one another by the actuation of the fluid cylinders 50 until both molding flasks 46*a* and 47*a* sandwich therebetween the match plate 5, as illustrated in FIG. 2. Subsequently, the squeezing plate 8 of the squeezing device 6 and the squeezing plate 9 of the squeezing device 7 are laterally advanced, until the squeezing plates 8 and 9 move into respective predetermined positions inside the molding flasks 46*a* and 47*a*. As a result, a molding cavity for an upper mold and a molding cavity for a lower mold are defined. Thereafter, the sand blower 10 is lowered until the sand supply ports of the blower 10 are aligned with the sand inlet ports 48 and 49 of both molding flasks 46*a* and 47*a*. Subsequently, sand is supplied from the sand blower 10 into the molding cavities under the action of a pressurized air which is applied to the sand blower 10. It should here be noted that the molding flasks 46*a* and 47*a* are provided, in the side walls thereof, with appropriate air vent holes so that the complete filling of sand into the molding cavities of both molding flasks is achieved. After the completion of the supply of sand, the squeezing plates 8 and 9 of the squeezing devices 6 and 7 are further advanced into the molding cavities of both molding flasks 46*a* and 47*a*, so that the sand within the molding cavities is compacted and hardened. Upon completion of the compacting operation of the squeezing devices 6 and 7, the squeezing plates 8 and 9 are retracted from the molding flasks 46*a* and 47*a*, respectively. Subsequently, by the actuation of the fluid cylinders 50 (FIG. 1), the molding flasks 46*a* and 47*a* are moved apart from one another. As a result, the parting of upper and lower sand molds from the match plate 5 is concurrently caused. That is, the upper sand mold is formed in the molding flask 46*a*, and the lower sand mold is formed in the molding flask 47*a*. Upon completion of the parting of the upper and lower sand molds from the match plate 5, the flask device 4 is rotated by the actuation of the fluid cylinder 52 through one hundred-eighty degrees, so that the molding flasks 46*a* and 47*a*, containing therein the formed sand molds, are brought into the second operating station. As a result, the molding flasks 46*a* and 47*a* take their positions corresponding to the positions of the molding flasks 46*b* and 47*b* illustrated in FIG. 1. At this stage, the other vacant molding flasks 46*b* and 47*b* are alternately brought into the first operating station, so that a fresh mold-forming operation is performed in the station by the employment of the molding flasks 46*b* and 47*b*. On the other hand, when the molding flasks 46*a* and 47*a* are positioned in the second operating station, a core (not illustrated in FIGS. 1 and 2) is placed in the lower mold contained in the molding flask 47*a* as required. Subsequently, the flask-support device 11 together with the mold-support device 11 are lifted until the uppermost end of the flask-support device 11 is abutted against the lowermost end of the molding flask 47*a*. Thereafter, the lifting motion of the flask-support device 11 is further conducted. Therefore, the molding flask 47*a* is pushed by the flask-support device 11 and is moved upwardly toward the molding flask 46*a*. It should here be noted that, during the upward movement of the molding flask 47*a*, the fluid cylinder 50 (FIG. 1) for the molding flask 47*a* is rendered ineffective, so that free movement of the molding flask 47*a* is permitted. However, alternately, prior to the lifting motion of the flask-support device 11 and the mold-support device 12, the molding flask 47*a* may firstly be moved upwardly by the actuation of its own fluid cylinder device 50 until the molding flask 47*a* is abutted against the molding flask 46*a*. Thereafter, the flask-support device 11 together with the mold-support device 12 are lifted until the uppermost end of the flask-support device 11 is abutted against the lowermost end of the molding flask 47*a*. When the uppermost end of the molding flask 47*a* is abutted against the lowermost end of the molding flask 46*a*, containing therein the formed upper sand mold, the upward movement of the molding flask 47*a* is stopped, since the molding flask 46*a* per se is prevented from being upwardly moved by the stops provided on the guide rods 44*a* or by the fluid cylinder 50 (FIG. 1) for the molding flask 46*a*. Thus, the upper and lower sand molds contained in the molding flasks 46*a* and 47*a* are jointed together. The flask-supported device 11 supports the jointed molding flasks 46*a* and 47*a*. It should be noted that the parting plane of the jointed sand molds is horizontal. After completion of the mold-joint operation by the molding flasks 46*a* and 47*a*, the mold-support device 12 is further lifted from the flask-support device 11 and is stopped when the uppermost surface of the mold-support device 12 contacts the lowermost face of the lower sand mold contained in the molding flask 47*a*. Subsequently, the mold-removing device 13 is lowered by the actuation of the fluid cylinder device 53 until the lowermost surface of the device 13 contacts the uppermost surface of the upper sand mold contained in the molding flask 46*a*. As a result, the upper and lower sand molds contained in the molding flasks 46*a* and 47*a* are held between the mold-support device 12 and the mold-removing device 13 as illustrated in FIG. 3. Thereafter, the mold-support device 12 and the mold-removing device 13, holding therebetween the upper and lower sand molds, are lowered together until the upper and lower sand molds are completely removed from the molding flasks 46*a* and 47*a*. After completion of the mold-removing operation, the mold-removing device 13 is returned to the uppermost position thereof. On the other hand, the mold-support device 12, supporting thereon the containerless upper and lower sand molds, is further lowered to a predetermined position above the flask-support device 11. Subsequently, the flask-support device 11 together with the mold-support device 12 are lowered to the lowermost position thereof. Concurrently, the molding flask 47*a* is lowered to the lowermost position thereof, so that the flask 47*a* is separated from the molding flask 46*a*. The containerless upper and lower molds supported on the mold-support device 12 are thereafter delivered to the casting station by means of an appropriate conveying means.

From the foregoing description of the embodiment, it will be understood that the following advantages can be obtained from the present invention.

(1) In the first operating station, since the match plate is vertically held between the molding flasks having sand inlet ports, through which the vertical filling of sand into the molding flasks is carried out, the effectiveness of filling of sand into the molding flasks can be very high. As a result, compact sand molds can be acquired.

(2) The vertical holding of the match plate is very effective for avoiding a distortion of the match plate per se during the compacting of the sand within the molding flasks.

(3) In the second operating station, since the mold-jointing operation as well as the mold-removing operation are carried out so that the parting plane of the upper and lower molds is kept horizontal, the delivery of the jointed upper and lower molds to the casting station can easily be achieved. Further, a core can be easily inserted into the lower sand mold before the delivery of the molds to the casting station.

(4) By the rotation of the flask device about an axis upwardly inclining fourty five degrees from a horizontal line, a sequential production of the sand molds can be achieved.

Figure 4:
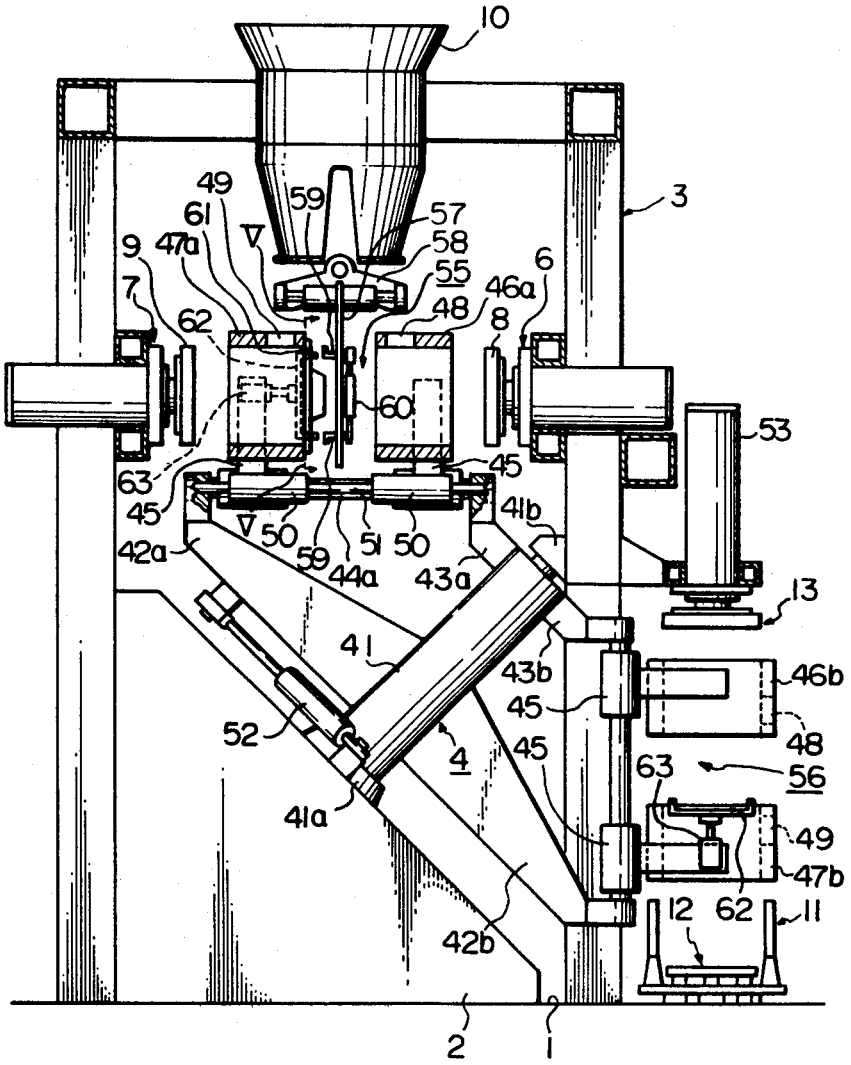
FIG. 4 is a front elevational view of a match plate molding apparatus according to a different embodiment of the present invention.
Figure 5:
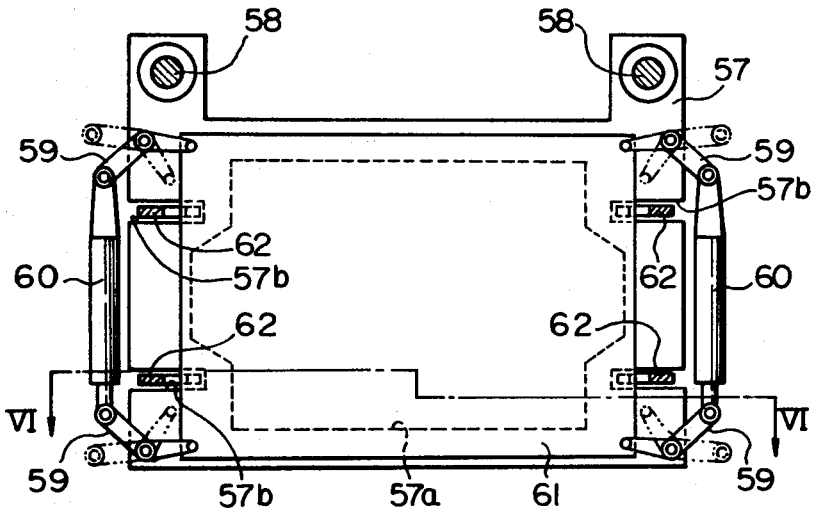
FIG. 5 is a partial side view taken along the line V—V of FIG. 4.
Figure 6:
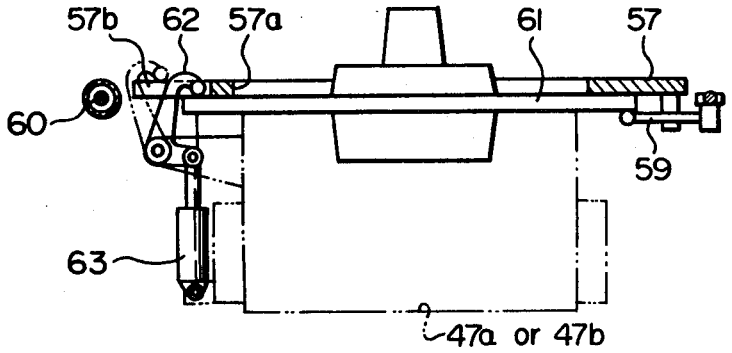
FIG. 6 is a cross-sectional view taken along the line VI—VI of FIG. 5.

FIGS. 4 through 6 illustrate a match plate mold-forming apparatus according to another embodiment of the present invention. Throughout FIGS. 4 through 6, the same reference numerals as those in FIGS. 1 through 3 designate the same or like elements and parts. It should be understood that the general arrangement and operation of the apparatus illustrated in FIGS. 4 through 6 are similar to those of the apparatus illustrated in FIGS. 1 through 3. The characteristic difference of the apparatus of FIGS. 4 through 6 from the apparatus of FIGS. 1 through 3 resides in the fact that a match plate carrying thereon a pattern or patterns can be readily replaced with a different match plate by the utilization of the movement of the flask device.

The characteristic arrangement of the apparatus of FIGS. 4 through 6 will now be described. Referring to FIG. 4, a first pair of molding flasks 46*a* and 47*a* for an upper and a lower mold, respectively and a second pair of molding flasks 46*b* and 47*b* for an upper and a lower mold, respectively are alternately movable between a first sand-squeezing station 55 and a second mold-removing station 56 by the rotation of a flask device 4, which rotation is caused by the actuation of a fluid cylinder device 52. FIG. 4 illustrates one condition in which the pair of molding flasks 46*a* and 47*a* is positioned in the first sand-squeezing station 55, and the other pair of molding flasks 46*b* and 47*b* is positioned in the second mold-removing station 56. In the first sand-squeezing station 55, a support plate 57 for mounting thereon a match plate is vertically hanging from a support device 58, so that the support plate is disposed between the molding flasks 46*a* and 47*a* which are usually retracted from one another on guide rods 44*a* and approach one another by the actuation of respective fluid cylinder devices 50 during the mold-forming operation. The support plate 57 is, therefore, located at a central position of the molding flasks 46*a* and 47*a* while these flasks are retracted from one another. The support plate 57 made of a generally rectangular plate is formed with a central bore 57*a* described later.

From the illustrations of FIGS. 5 and 6, in addition to that of FIG. 4, it should be appreciated that a match plate 61 is removably mounted on the support plate 57 by means of clamps 59, which are operated by conventional fluid cylinder devices 60. More specifically, the match plate 61 is fixed to the support plate 57 while the mold-forming operation is continuously carried out. On the other hand, the removal of the match plate 61 from the support plate 57 is conducted when the match plate 61 is replaced with a different match plate. The clamps 59 and the fluid cylinder devices 60 should be understood as a match-plate clamping means provided for the support plate 57. As illustrated in FIGS. 4 through 6, the molding flasks 47*a* and 47*b* for a lower sand mold are provided with holding members 62 which are operated by conventional fluid cylinder devices 63 attached to support legs 45 of the molding flasks 47*a* and 47*b*. The holding members 62 and the fluid cylinder devices 63 are used for achieving the replacement of the match plate 61 with a different match plate. The holding members 62 hold the match plate 61 on the molding flasks 47*a* and 47*b* upon being operated by the fluid cylinder devices 63. Therefore, the holding members 62 and the fluid cylinder devices 63 can be understood as a match-plate holding means provided for each of the molding flasks 47*a* and 47*b*.

With the above-mentioned arrangement of the apparatus of FIGS. 4 through 6, the mold-forming operation is commenced in the sand-squeezing station 55 after the completion of fixing of the match plate 61 to the support plate 57. When the mold-forming operation is started by employing, for example, the molding flasks 46*a* and 47*a*, these flasks 46*a* and 47*a* are initially moved toward one another until the match plate 61 fixed to the support plate 57 is held between the two molding flasks 46*a* and 47*a*. At this stage, the molding flask 46*a* can approach the match plate 61 while passing through the central bore 57*a* of the support plate 57. Thereafter, the sand-filling operation, the sand-squeezing operation and the mold-parting operation are sequentially performed in the same manner as with the apparatus according to the first embodiment of FIGS. 1 through 3. After the completion of the mold-forming operation by the molding flasks 46*a* and 47*a*, the flask device 4 is rotated through one hundred eighty degrees. As a result, the molding flasks 46*a* and 47*a* are brought to the second mold-removing station 56, and alternately, the molding flasks 46*b* and 47*b* are brought to the first sand-squeezing station. Subsequently, in the second mold-removing station, the mold-jointing operation and the mold-removing operation are carried out in the same manner as previously described with respect to the apparatus according to the first embodiment. Further, in the first sand-squeezing station, the mold-forming operation is performed by employing the molding flasks 46*b* and 47*b* in the same manner as the molding flasks 46*a* and 47*a*.

The operation for replacing the match plate 61 with a different match plate will now be described. It is assumed that, as illustrated in FIG. 4, a pair of vacant molding flasks 46*a* and 47*a* is positioned in the first sand-squeezing station 55 and a pair of vacant molding flasks 46*b* and 47*b* is positioned in the second mold-removing station 56. A fresh match plate by which the match plate 61 on the support plate 57 is replaced, is manually placed on the upper end of the molding flask 47*b*. Subsequently, the fresh match plate is rigidly held on the molding flask 47*b* by means of the match plate holding means. On the other hand, in the sand-squeezing station 55, the molding flask 47*a* is moved toward and is contacted with the match plate 61 fixed to the support plate 57. Subsequently, by the actuation of the fluid cylinder devices 63, the holding members 62 of the molding flask 47*a* hold the match plate 61. Thereafter, the match plate 61 clamped by the clamps 59 of the support plate 57 is released from the support plate 57 by the actuation of the fluid cylinders 60. The releasing of the match plate 61 is attained by the rotation of the clamps 59 which is caused by the actuation of the fluid cylinder device 60. Slots 57*b* of the support plate 57 are provided for permitting the rotation of the holding members 62. Subsequently, the molding flask 47*a* is retracted from the support plate 57 while holding thereon the match plate 61. FIG. 4 illustrates the retracted molding flask 47*a* on which the match plate 61 is held. After the completion of the retraction of the molding flask 47*a*, the flask device 4 is rotated through one hundred eighty degrees by the actuation of a fluid cylinder device 52. As a result, the pair of molding flasks 46*a* and 47*a* is brought to the second mold-removing station 56, and concurrently, the pair of molding flasks 46*b* and 47*b* is brought to the first sand-squeezing station 55. In the second mold-removing station 56, the holding of the match plate 61 by means of the holding members 62 is released by the actuation of the fluid cylinder devices 63. After releasing of the holding members 62, the match plate 61 is removed manually from the molding flask 47*a*. On the other hand, in the first sand-squeezing station, the fresh match plate held on the molding flask 47*b* is transferred to the support plate 57. The transferring of the fresh match plate from the molding flask 47*b* to the support plate 57 is carried out by the method contrary to that of the aforementioned transferring of the match plate 61 from the support plate 57 to the molding flask 47*a*. The fresh match plate is then rigidly clamped on the support plate 57 by means of the clamping means. After the clamping of the fresh match plate; the mold-forming operation is started. In the foregoing operation for replacing the match plate 61 with the fresh match plate, it was assumed that the two pairs of molding flasks 46*a*, 47*a* and 46*b*, 47*b* are vacant. However, the operation for replacing the match plate 61 with the fresh match plate may be carried out immediately after the sand-squeezing operation in the first sand-squeezing operation in the first sand-squeezing station 55. In this case, the transferring of the match plate 61 from the support plate 57 to the molding flask 47*a* is carried out at the same time as the mold-parting operation. As a result, in the mold-removing station 56, the removal of the match plate 61 from the molding flask 46*a* is carried out at the same time as the mold-removing operation. Consequently, a rapid replacement of the used match plate 61 with a fresh match plate can be achieved, since the replacing operation of a match plate is conducted without interrupting the continuous mold-forming operation.

From the foregoing description of the match plate mold-forming apparatus according to the embodiment of FIGS. 4 through 6, it will be understood that the replacement of a used match plate with a fresh match plate can be readily and automatically performed.

I claim:

1. A two station apparatus for producing containerless sand molds comprising:

a framework generally extending upwardly from a base floor for providing a rigid construction for the apparatus, said framework establishing a working area having only two stations, a mold-forming first station and a mold-removing second station;

a first and a second pair of molding flasks for an upper and a lower sand mold, said molding flasks being movable toward and away from one another along a guide rod means;

means for alternately positioning each said pair of molding flasks in said mold-forming first station and said mold-removing second station, said means comprising a rotating shaft arranged between said mold-forming first station and said mold-removing second station, and at least a guide rod carried by said rotating shaft and slidably supporting thereon each said pair of molding flasks, said guide rod having an axis thereof extending in parallel with said predetermined horizontal axis when said guide rod is positioned in said mold-forming first station, and in parallel with said predetermined vertical axis when said guide rod is positioned in said mold-removing second station, said rotating shaft having an axis of rotation thereof extending along a line which bisects an angle between said predetermined horizontal axis and said predetermined vertical axis;

a match plate vertically arranged in said mold-forming first station at a position adapted for being held between each said pair of molding flasks when each said pair of molding flasks is positioned in said mold-forming first station;

a pair of squeezing devices mounted on said framework and arranged on laterally opposite sides of and in alignment with said match plate, said squeezing devices being laterally movable toward and away from one another along a predetermined horizontal axis extending in said mold-forming first station;

a sand blower means mounted on said framework and arranged above said match plate, for supplying sand into each said pair of molding flasks;

a flask-support device arranged in a vertically lower section of said mold-removing second station, said flask-support device being movable along a predetermined vertical axis extending in said mold-removing second station for supporting said molding flasks when each said pair of molding devices is positioned in said mold-removing second station;

a mold-support device arranged in common with said flask-support device in said vertically lower section of said mold-removing second station, said mold-support device being movable along said predetermined vertical axis and independently of said flask-support device;

a mold-removing device arranged in a vertically upper section of said mold-removing second station, said mold-removing device being movable along said predetermined vertical axis in cooperation with said mold-support device for removing said upper and lower sand molds from each said pair of molding flasks; and means for replacing said match plate with a different match plate, said replacing means comprising a support plate arranged in said mold-forming first station for vertically supporting thereon said match plate; means for releasably clamping said match plate, said clamping means being attached to said support plate; means for releasably holding said match plate on one of said first and second pairs of molding flasks, said holding means being provided for said one of said first and second pairs of molding flasks, and; means for transferring said match plate between said support plate and said one of said first and second pairs of molding flasks.

2. An apparatus according to claim 1, wherein said means for releasably clamping said match plate comprises clamps actuated by fluid-operated cylinders, wherein said means for releasably holding said match plate comprises holding members actuated by fluid cylinder device, and wherein said means for transferring said match plate comprises a fluid-operated cylinder for moving said one of said first and second pairs of molding flasks toward and away from said support plate along said guide rod means.

3. An apparatus according to claim 2, wherein said sand blower means has two laterally spaced apart sand supply ports for vertically supplying sand under a pressure of air, and wherein said molding flasks are respectively formed with a sand inlet port connectable to one of said sand supply ports of said sand blower means when said sand molding flasks have been moved toward one another.

4. An apparatus according to claim 2, wherein each of said squeezing devices comprises a squeezing plate for compacting sand when said pair of molding flasks is filled with said sand.

* * * * *